United States Patent [19]

Yoshimura

[11] 4,162,807

[45] Jul. 31, 1979

[54] LUMBAR SUPPORT REGULATING APPARATUS

[75] Inventor: Noboru Yoshimura, Toyota, Japan

[73] Assignee: Aisin Seiki Kabushiki Kaisha, Kariya, Japan

[21] Appl. No.: 847,465

[22] Filed: Oct. 31, 1977

[30] Foreign Application Priority Data

Nov. 1, 1976 [JP] Japan ..... 51-131381
Nov. 22, 1976 [JP] Japan ..... 51-140580

[51] Int. Cl.[2] ..... A47C 7/46
[52] U.S. Cl. ..... 297/284; 267/89
[58] Field of Search ..... 297/284, 304; 248/378, 248/383, 373; 267/89

[56] References Cited

U.S. PATENT DOCUMENTS

| | | | |
|---|---|---|---|
| 3,031,164 | 4/1962 | Schopf | 248/373 |
| 3,285,562 | 11/1966 | Langer | 248/378 X |
| 3,378,299 | 4/1968 | Sandor | 297/284 |
| 3,659,819 | 5/1972 | Wolters | 297/304 |
| 3,973,797 | 8/1976 | Obermeier et al. | 297/284 |
| 4,019,777 | 4/1977 | Hayashi | 297/284 |

*Primary Examiner*—Francis K. Zugel
*Attorney, Agent, or Firm*—Sughrue, Rothwell, Mion, Zinn and Macpeak

[57] ABSTRACT

A vehicle seat of the type having a seat back with a plurality of transverse serpentine springs therein is provided with a regulating apparatus for adjusting the firmness of the lower most springs to adjust the firmness of the seat back in the lumbar region. A torsion spring is wrapped about a vertically extending post in the lower corner of the seat back with the ends thereof operatively engaged with a lumbar plate engaging the seat spring adjacent the lower center portion of the seat back and with an intermediate portion of the spring extending outwardly from the post in engagement with a rotatable cam having surfaces of different radii engagable with the intermediate portion of the spring to vary the force of the torsion spring on the seat spring.

5 Claims, 11 Drawing Figures

FIG. 1
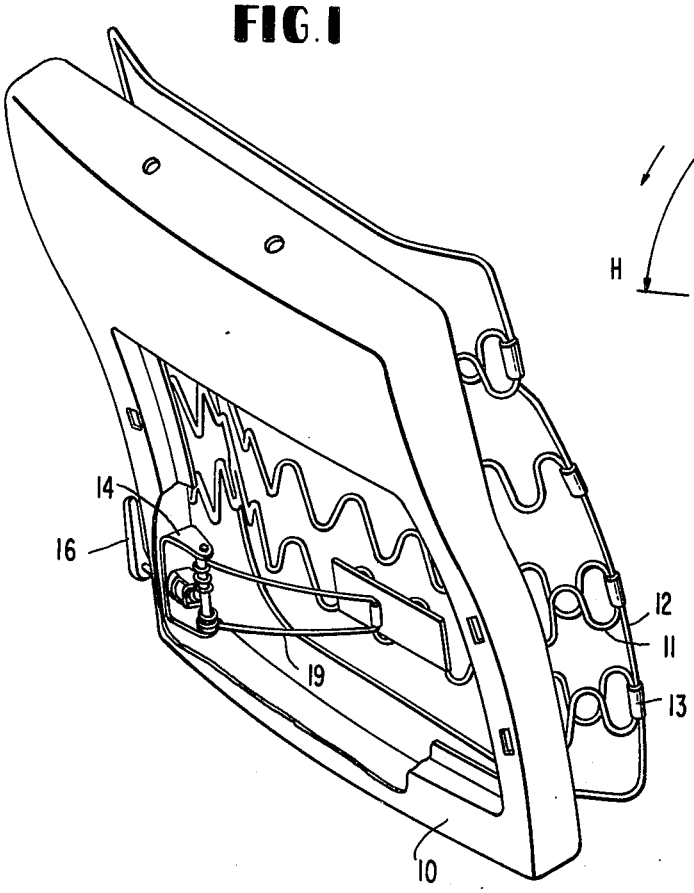
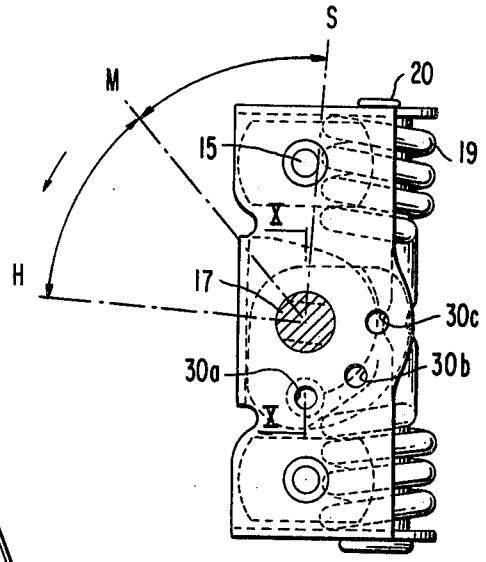
FIG. 5
FIG. 6
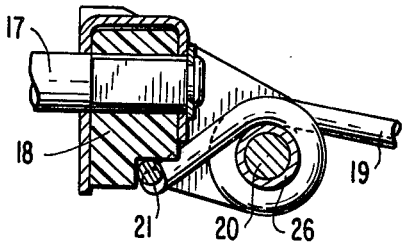
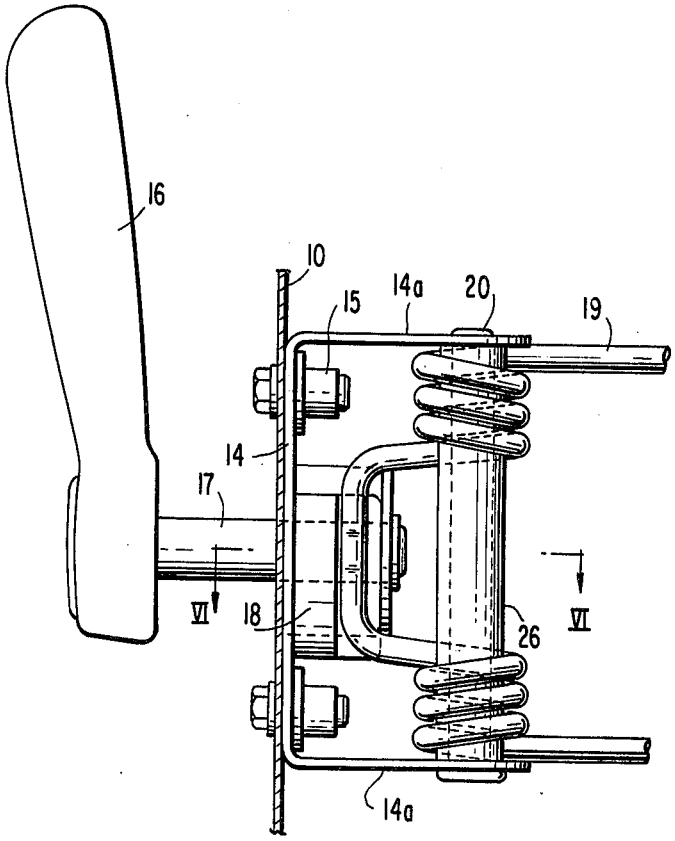
FIG. 3

LUMBAR SUPPORT REGULATING APPARATUS

BACKGROUND OF THE INVENTION

1. Field of the Invention

The present invention relates generally to a lumbar support regulating apparatus in a seat back and more particularly to such an apparatus in a vehicle seat back.

2. Description of the Prior Art

In general, the use of a lumbar support regulating apparatus in the seat back of a motor vehicle seat is known so that the hardness of the cushion of the seat back which is in contact with the lumbar region of a person seated on the seat can be suitably regulated.

An example of such a construction is the U.S. Pat. to Sandor No. 3,378,299, granted Apr. 16, 1968 which uses pivoted lever members in the seat back. One arm of the lever engages the seat spring to vary the firmness thereof and the other arm of the lever is connected to a cable which may be wound up on a rotatable shaft to vary the force with which the lever is pressed against the seat spring.

Also known is the patent to Hayashi, U.S. Pat. No. 4,019,777, granted Apr. 26, 1977 wherein a torsion spring is wrapped about a vertically extending post secured to the frame of a seal back. One arm of the torsion lever is secured to a plate which is disposed in engagement with the seat springs and the opposite end of the torsion spring is engaged with a travelling nut threaded on a rotatable control shaft so that upon rotation of the shaft the force applied to the torsion spring will be varied to adjust the support pressure applied to the seat springs. Due to the axial movement of the nut on the control shaft, the post about which the torsion spring is wrapped must be offset a considerable distance from the axis of the control shaft thereby necessitating the use of a fairly thick seat back frame.

SUMMARY OF THE INVENTION

The present in provides an improved lumbar support regulating apparatus which obviates the drawbacks of the above-mentioned conventional regulating devices.

The lumbar support regulating apparatus according to the present invention provides a unique and highly simplified lumbar support regulating apparatus.

The lumbar support regulating apparatus according to the present invention is comprised of a torsion spring which is wrapped about a vertically extending pivot post secured to the frame of a seat back. The free ends of the torsion spring are connected to a plate which is adapted to engage the springs of the seat back at the lower central portion thereof. The intermediate portion of the spring extends outwardly from the pivot shaft and is engaged with the rotatable cam member having surfaces of different radii thereon for varying the force which will be applied by the torsion spring to the spring engaging plate thereby varying the degree of firmness of the seat back. Since the cam surfaces move the intermediate portion of the torsion spring in a radial direction relative to the axis of the control shaft upon which the cam member is secured for rotation, the pivot shaft for the spring can be located very close to the axis of the control shaft. Therefore, it is possible to use a thinner seal back from than previously possible with the prior arrangements wherein the torsion spring was acted upon by an axially movable member.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a rear perspective view of a seat back showing the interior of the seat back according to the present invention.

FIG. 3 is an enlarged front elevational view of the torsion spring regulating apparatus according to the present invention.

FIG. 5 is a side view in elevation of the torsion spring regulating apparatus according to the present invention.

FIG. 6 is a sectional view taken along the line VI—VI in FIG. 3.

DETAILED DESCRIPTION OF THE INVENTION

Figures 2, 4, 7, 8, 9, 10, 11:
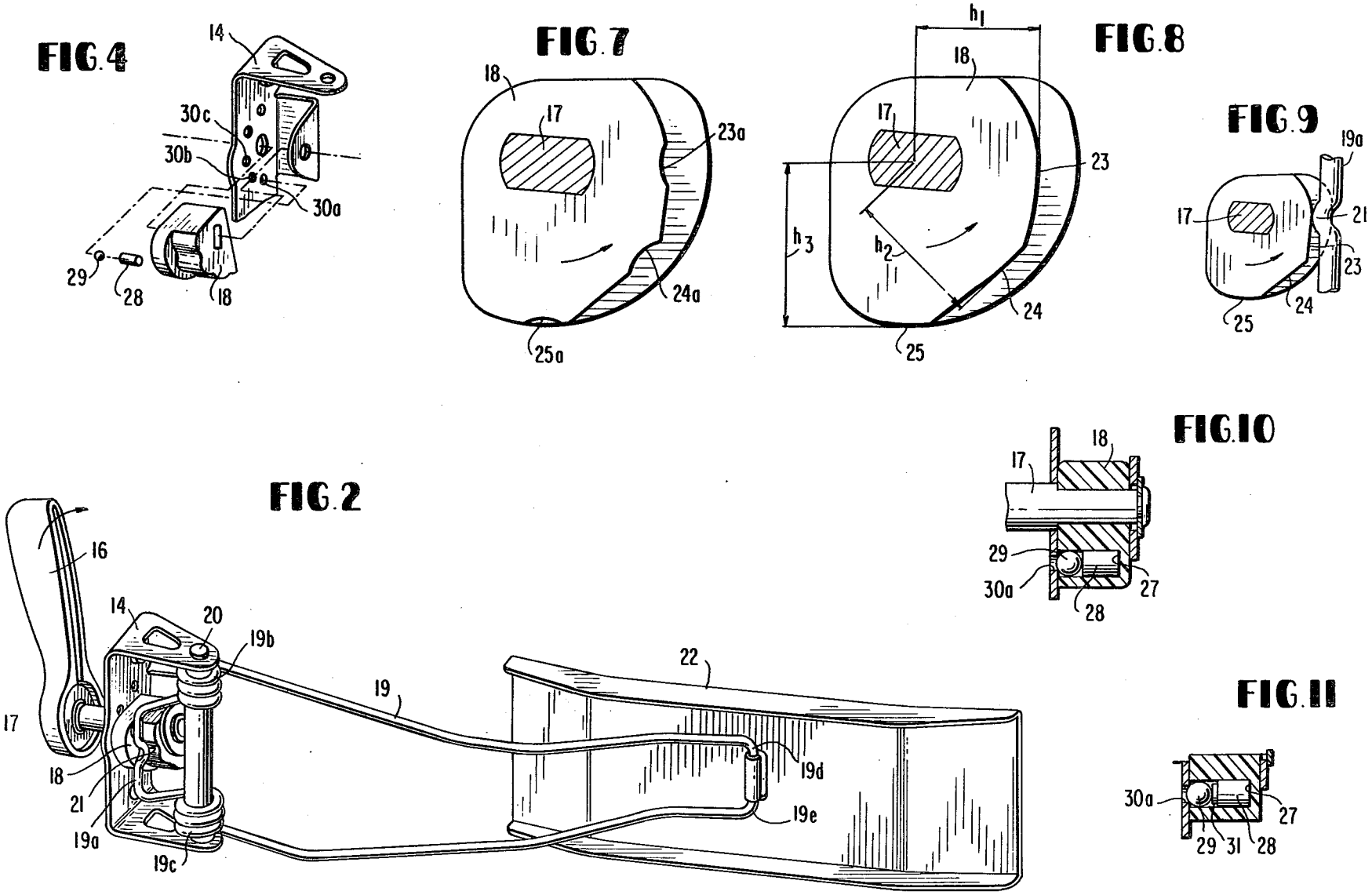
FIG. 2 is a view similar to FIG. 1 but showing only the details of the torsion spring regulating apparatus of the present invention.
FIG. 4 is an exploded view showing the relationship between the cam and the supporting bracket.
FIG. 7 is an explanatory side view of the cam according to the present invention.
FIG. 8 is a view similar to FIG. 7 showing a modified form of the cam of the present invention.
FIG. 9 is a view similar to FIG. 8 showing the engaging relationship between a torsion spring and the cam of FIG. 8.
FIG. 10 is a view similar to FIG. 6 taken along the line X—X in FIG. 5.
FIG. 11 is a view similar to FIG. 10 showing a modified construction.

As best seen in FIG. 1, the seat back frame 10 is provided with a plurality of serpentine springs 11 extending transversely of the seat back frame and secured at one end thereto. An outer frame 12 extends about the outer circumference of the seat back frame 10 and is secured to the other end of the springs 11 by means of clamps 13. A C-shaped bracket 14 is secured to the frame 10 by means of bolts 15. An operating shaft 17 having a handle 16 at one end thereof is rotatably supported in an aperture extending through the frame and the central portion of the bracket 14. A cam 18 which may be made of any suitable plastics material is secured at the end of the shaft 17 opposite the handle 16 for rotation therewith. A pin 20 having a cover 26 of plastics material is rotatably mounted in the opposed flanges **14*a* of the bracket 14**.

A torsion spring 19 of suitable material such as steel or the like is provided with a C-shaped central portion **19*a* which extends outwardly from the shaft 20 into engagement with the surface of the cam 18. The spring 19 is coiled about opposite ends of the shaft 20 at 19*b* and 19*c*. The opposite ends of the torsion spring 19 extend outwardly away from the shaft 20 and terminate in bent end portions 19*d* and 19*e* which are engaged by a suitable connector on the rear surface of a lumbar support plate 22**.

The lumbar support plate 22 is disposed in engagement with the seat back spring 11 adjacent the lower central part of the seat back which is adapted to be adjacent to the lumbar region of the person seated thereon.

The cam 18 is provided with a plurality of cam faces 23, 24 and 25 which are adapted to engage the projection 21 on the C-shaped portion 19*a* of the torsion spring as shown in FIG. 8. The cam faces 23, 24 and 25 are flat surfaces which are tangential to arcs having radii of $h_1$, $h_2$ and $h_3$, respectively. Thus, when the torsion spring engages the cam surface at the tangential flat surfaces, the force will be directed toward the center of the cam 18 so as not to cause any undue reactions tending to rotate the cam 18. The cam 18 may be rotated by turning the handle 16 to rotate the shaft 17 having the cam 18 secured thereto. Upon rotation of the cam, the projection 21 will smoothly shift from engagement with one cam surface to the other. When the cam face 23 is engaged with the projection 21 of the torsion spring 19, the hardness of the seat back will be relatively soft since the force acting on the spring 11 through the lumbar support plate 22 is relatively weak. When the projection 21 of the torsion spring 19 is engaged with the cam faces 24 and 25 in sequence, the hardness of the seat back will be relatively medium and hard, respectively, due to the increase in the radial distance of the cam surfaces from the center of rotation of the shaft 17. In order to more securely hold the cam in each regulating position, the cam surfaces may be provided with recesses at 23*a*, 24*a* and 25*a* in which the projection 21 on the torsion spring 19 will rest in each adjusted position.

To further insure the location and holding of the cam in each regulated position, the cam 18 may be provided with a cylindrical blind bore 27 which is parallel to the shaft 17 and extends inwardly from the face of the cam adjacent the bracket 14 as viewed in FIGS. 10 and 11. A compression member such as a cylindrical piece of rubber 28 and a ball 29 are inserted into the bore 27. Holes 30*a*, 30*b* and 30*c* having a diameter smaller than the diameter of the ball 29 extends through the central portion of the bracket 14 in a circle about the axis of rotation of the shaft 17. Thus as the cam 18 is rotated to each regulating position, the ball 29 will engage in holes 30*a*, 30*b* and 30*c*, respectively, as a result of the compressive force exerted by the rubber member 28. The compressive force of the cylindrical rubber member 28 can be increased by interposing a plate 31 between the ball 29 and the rubber cylinder 28 as viewed in FIG. 11. The remaining holes shown in FIGS. 2 and 4 which lie in the same circle as the holes 30*a*, 30*b* and 30*c* are provided so that the same bracket could be used for attachment to the opposite side of the seat frame 10 when the seat is located at the opposite side of the car.

To summarize the operation of the lumbar support regulating apparatus, the handle 16 may be rotated in a direction of the arrow in FIGS. 2 or 5 to progressively adjust the firmness of the seat back from soft to medium to hard. The cam 18 will be sequentially rotated in a counter-clockwise direction about the axis of the shaft 17 as viewed in FIGS. 7–9 so that the projection 21 on the central portion 19*a* of the torsion spring 19 will be sequentially engaged with the cam faces 23, 24 and 25 of the cam 18. The distances of the cam faces from the center of rotation of the shaft 17 progressively increase which will tend rotate the torsion spring 19 about the pin 20 in a counter-clockwise direction as viewed in FIG. 6 so that spring 19 will act with increasing force on the lumbar support plate 22 as the cam is rotated to sequentially bring the cam surfaces 23, 24 and 25 into engagement with the spring 19 in that order. The engagement of the projection 21 of the spring 19 with the notches 23*a*, 24*a* and 25*a* and/or the engagement of the ball 29 with the holes 30*a*, 30*b* and 30*c* will securely hold the cam 18 in each adjusted position.

Obviously many modifications and variations of the present invention are possible in light of the above teachings. It is therefore understood that with the scope of the appended claims the present invention may be practiced otherwise than as specifically described herein.

What is claimed is:

1. A lumbar support regulating apparatus disposed within a seat back comprising a rigid seat back frame, spring means secured to said seat back frame, a torsion spring, pivot means on said frame pivotally supporting said torsion spring and disposed parallel to said seat back frame, a lumbar support plate connected to one end of said torsion spring and disposed between said spring means and said torsion spring to distribute the force of said torsion spring to said spring means, cam means rotatably mounted on said frame on an axis parallel to said seat back frame and including a cam having a plurality of radially disposed cam faces thereon engageable with the other end of said torsion spring, said pivot means being disposed orthogonal to the axis of rotation of said cam and positioned axially of said cam so as to be within the radial extent of said cam and means for locating said cam relative to the other end of said torsion spring.

2. A lumbar support regulating apparatus as set forth in claim 1, wherein said cam faces are each disposed at a different distance from the axis of rotation of said cam means so that upon rotation of said cam means the force applied by said one end of said torsion spring to said lumbar support plate and said spring means will be varied.

3. A lumbar support regulating apparatus as set forth in claim 1, wherein said torsion spring is provided with a projection engageable with said cam faces of said cam means and each of said cam faces is provided with a recessed portion for engagement with said projection to hold a cam means in said selected position.

4. A lumbar support regulating apparatus as set forth in claim 1 wherein said detent means includes a ball member and a resilient member mounted for rotation with said cam means and a plurality of holes formed in said frame about the axis of rotation of said cam means whereby said resilient member will bias said ball member into a selected hole upon rotation of said cam means to bring a selected cam face into engagement with said torsion spring.

5. A lumbar support regulating apparatus as set forth in claim 4, wherein said ball member and said resilient member are disposed in a bore in said cam member parallel to the axis of rotation thereof, said resilient member being comprised of a cylindrical piece of rubber and a rigid plate interposed between said ball member and one end of said cylindrical piece of rubber.

* * * * *